US012704051B2

(12) United States Patent
Troyer et al.

(10) Patent No.: US 12,704,051 B2
(45) Date of Patent: Aug. 11, 2026

(54) GAS LIFT VALVE

(71) Applicant: DEVON ENERGY CORPORATION, Oklahoma City, OK (US)

(72) Inventors: Andrew Troyer, Hydro, OK (US); Travis Dean, Edmond, OK (US)

(73) Assignee: DEVON ENERGY CORPORATION, Oklahoma City, OK (US)

( * ) Notice: Subject to any disclaimer, the term of this patent is extended or adjusted under 35 U.S.C. 154(b) by 0 days.

(21) Appl. No.: 18/899,542

(22) Filed: Sep. 27, 2024

(65) Prior Publication Data

US 2025/0109670 A1 Apr. 3, 2025

Related U.S. Application Data

(60) Provisional application No. 63/541,095, filed on Sep. 28, 2023.

(51) Int. Cl.
*E21B 43/12* (2006.01)
*E21B 34/06* (2006.01)

(52) U.S. Cl.
CPC ..... *E21B 43/123* (2013.01); *E21B 34/06* (2013.01); *E21B 2200/04* (2020.05)

(58) Field of Classification Search
CPC ..... E21B 43/123; E21B 34/08; E21B 43/122; E21B 2200/04
See application file for complete search history.

(56) References Cited

U.S. PATENT DOCUMENTS

| | | | |
|---|---|---|---|
| 5,421,241 | A | 6/1995 | Terral |
| 7,954,545 | B2 | 6/2011 | Hearn et al. |
| 8,162,060 | B2 | 4/2012 | Randazzo |
| 8,763,706 | B2 | 7/2014 | Lembcke |
| 9,010,353 | B2 | 4/2015 | Salihbegovic |
| 9,057,255 | B2 | 6/2015 | Juenke |
| 9,546,541 | B2 | 1/2017 | Wang et al. |
| 9,593,554 | B2 | 3/2017 | Salihbegovic |
| 11,428,084 | B2 | 8/2022 | Fraser et al. |
| 11,549,603 | B2 | 1/2023 | Haines et al. |
| 11,585,186 | B2 | 2/2023 | Coyes et al. |
| 11,608,709 | B2 | 3/2023 | Pola et al. |
| 2013/0220599 | A1 | 8/2013 | Rae |
| 2013/0312833 | A1 | 11/2013 | Salihbegovic |
| 2020/0032627 | A1 | 1/2020 | Salihbegovic et al. |
| 2022/0106857 | A1 | 4/2022 | Williams et al. |

(Continued)

FOREIGN PATENT DOCUMENTS

CA 2971577 C * 12/2022 ..... F16K 1/126

OTHER PUBLICATIONS

English translation of DK2554787. (Year: 2018).*

(Continued)

*Primary Examiner* — Zakiya W Bates
(74) *Attorney, Agent, or Firm* — McAfee & Taft

(57) ABSTRACT

A gas lift valve for use in a wellbore has a housing with an injection fluid inlet port and an injection fluid outlet connected to a production tubing. The gas lift valve has a sealing ball engaged with a valve seat, and the sealing ball is disengaged from the valve seat to open a pathway from the injection fluid inlet through the injection fluid outlet into the production tubing solely as a result of injection fluid pressure in an annulus between the housing and the wellbore.

16 Claims, 4 Drawing Sheets

(56) References Cited

U.S. PATENT DOCUMENTS

| | | | |
|---|---|---|---|
| 2023/0011486 | A1 | 1/2023 | Quinn et al. |
| 2023/0111681 | A1 | 4/2023 | Haines et al. |

OTHER PUBLICATIONS

Schlumberger, "Injection-Pressure-Operated Gas Lift Valves", Gas-Lift Equipment Catalog, not dated but admitted as prior art, pp. 1-12.
"Tubing Pressure Operated Valve Design", Chapter VIII, not dated but admitted as prior art, pp. 8-001-8-017.
Weatherford, "S Series SPM Mandrel (1-in. ID Pocket)", Tech Specs, not dated but admitted as prior art, pp. 1-7.
Weatherford, "Ultra-HP Wireline-Retrievable Injection-Pressure-Operated Gas-Lift Valve", Tech Specs, 2016, pp. 1-2.
Weatherford, "CM Series Tubing-Retrievable Conventional Mandrels", Gas-Lift Mandrels, 2007-2013, pp. 1-2.
Weatherford, "SBRO-DVX Side-Pocket Gas-Lift Mandrel", Tech Specs, 2005-2016, pp. 1-2.

* cited by examiner

GAS LIFT VALVE

CROSS REFERENCE TO RELATED APPLICATION

The present application claims priority to U.S. Provisional Application No. 63/541,095 filed on Sep. 28, 2023, the entirety of which is incorporated by reference herein.

BACKGROUND

Hydrocarbons, such as oil and gas, are produced or obtained from subterranean reservoir formations that may be located onshore or offshore. The development of subterranean operations and the processes involved in removing hydrocarbons from a subterranean formation typically involve several different steps, for example, drilling a wellbore at a desired well site, treating the wellbore to optimize production of hydrocarbons, and performing the necessary steps to produce the hydrocarbons from the subterranean formation. Wellbores may be completed by inserting a casing into the wellbore and cementing the casing with cement. Alternatively, the wellbore may remain uncased as an "open hole" or may be partially cased. In either case, production tubing is inserted in the wellbore to convey production fluid to the surface.

In many cases, pressure in the wellbore is insufficient to cause the production fluid to be delivered upwardly in the production tubing to the surface. In such cases, artificial lift systems may be used to urge the production fluid upwardly. One type of artificial lift system is a gas lift valve. Gas lift valves receive gas injected into the wellbore and communicate the injected gas into the production tubing.

DESCRIPTION OF AN EMBODIMENT

Figure 1:
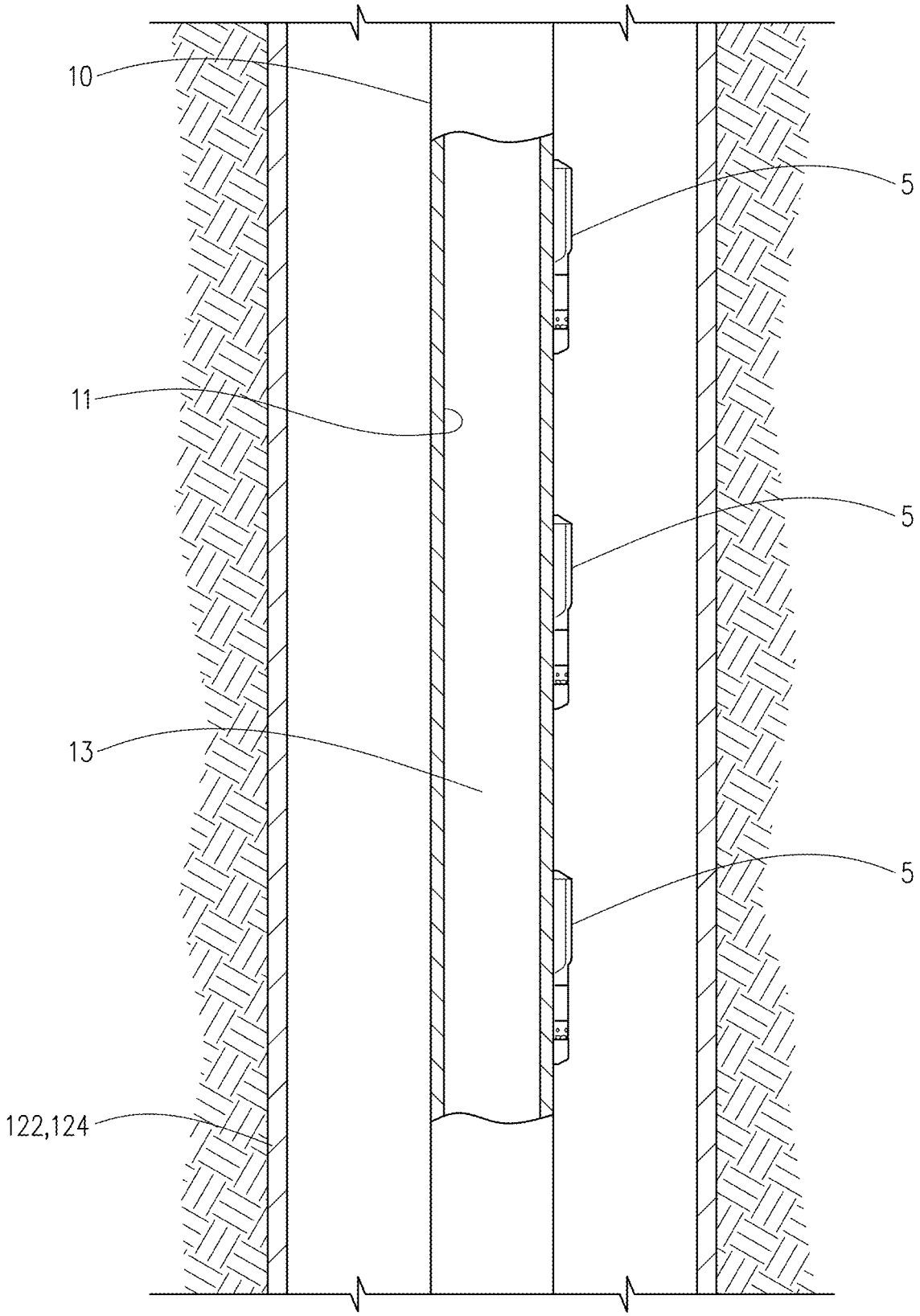
FIG. 1 is a schematic view showing gas lift valves connected to a production tubing in a wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. It should also be understood that, as used herein, "first," "second," and "third" are assigned arbitrarily and are merely intended to differentiate between two or more components, flow ports, etc., as the case may be, and does not indicate any sequence. Furthermore, it is to be understood that the mere use of the word "first" does not require that there be any "second," and the mere use of the word "second" does not require that there be any "third," etc.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis. A wellbore can include vertical, inclined, or horizontal portions, and can be straight or curved.

Figure 2:
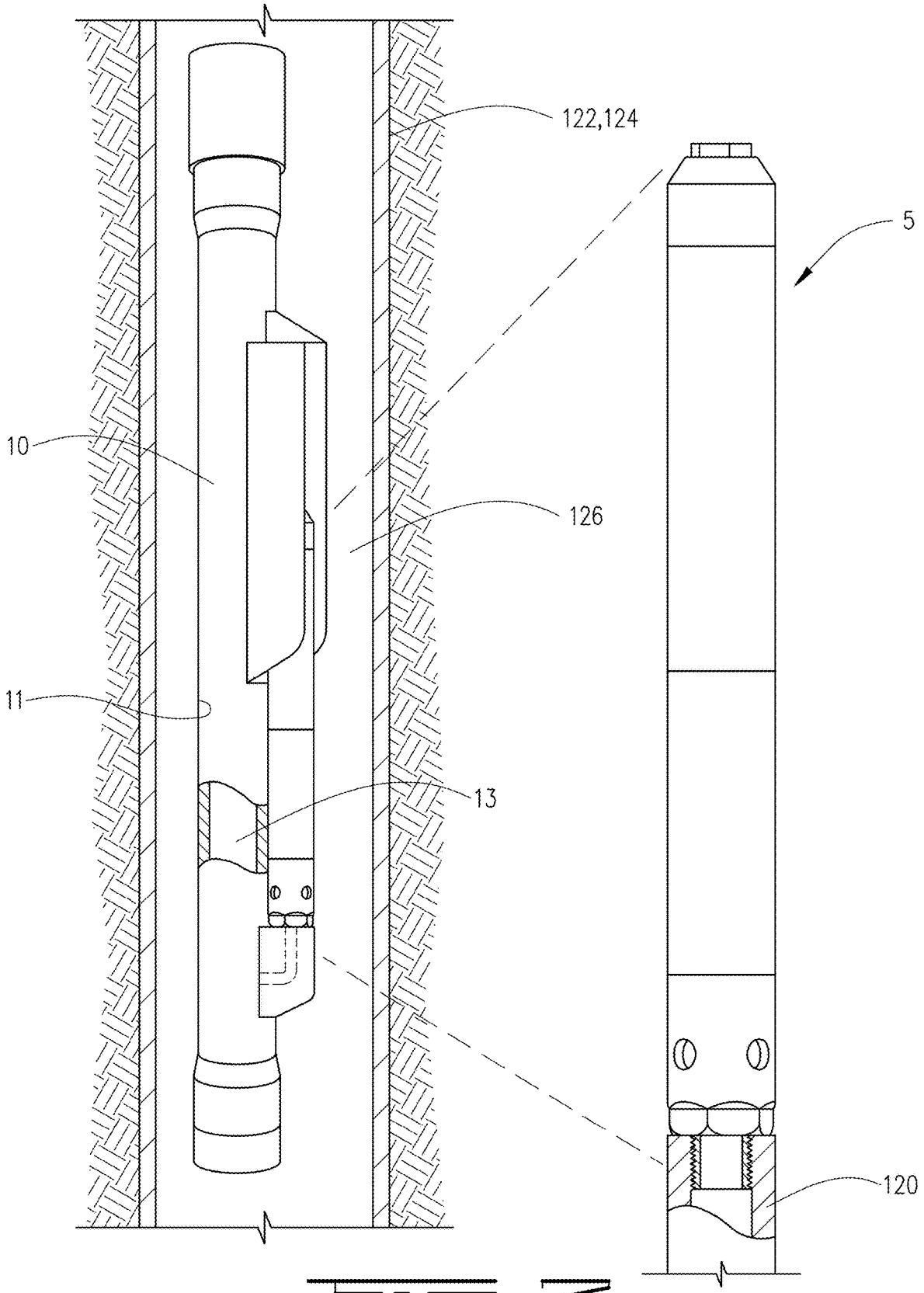
FIG. 2 is an elevation view of a gas lift valve mounted to a production tubing.
Figure 3:
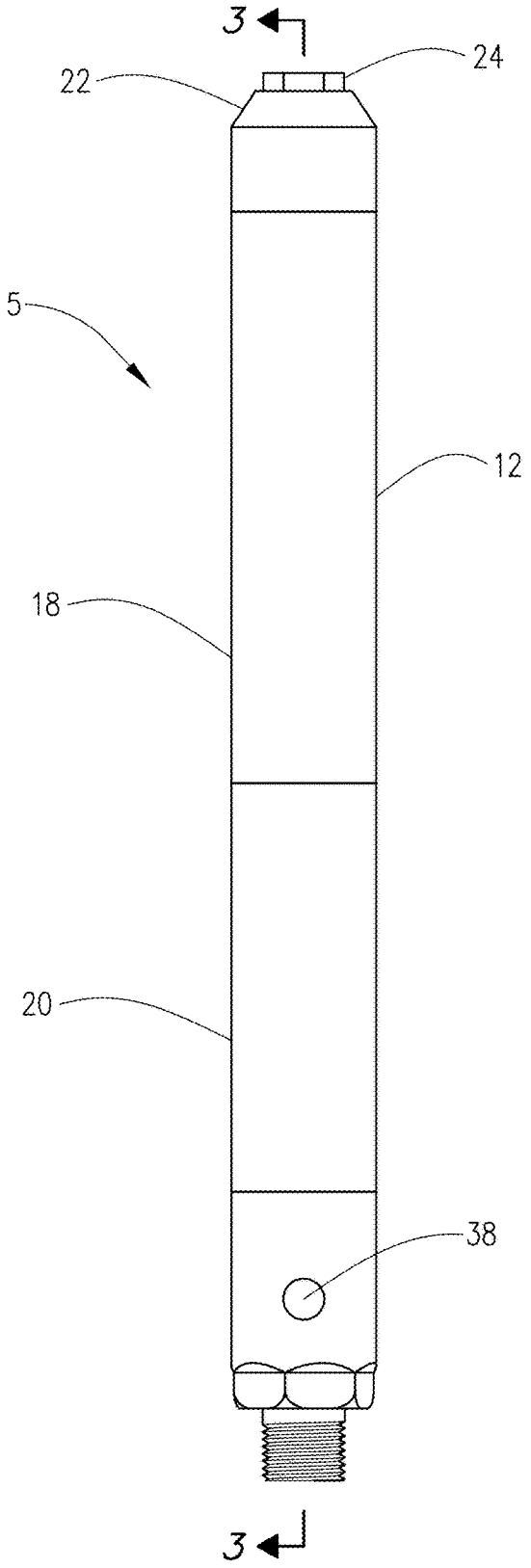
FIG. 3 is an elevation view of a gas lift valve.
Figure 4:
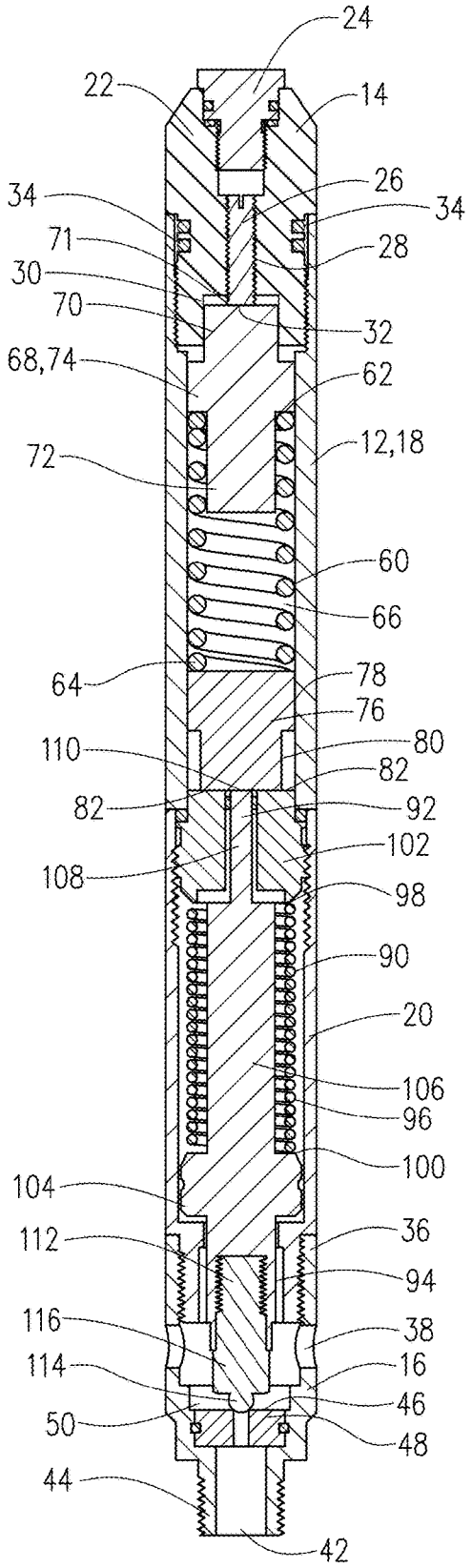
FIG. 4 is a cross-sectional view from lines 3-3 of FIG. 2.
Figure 5:
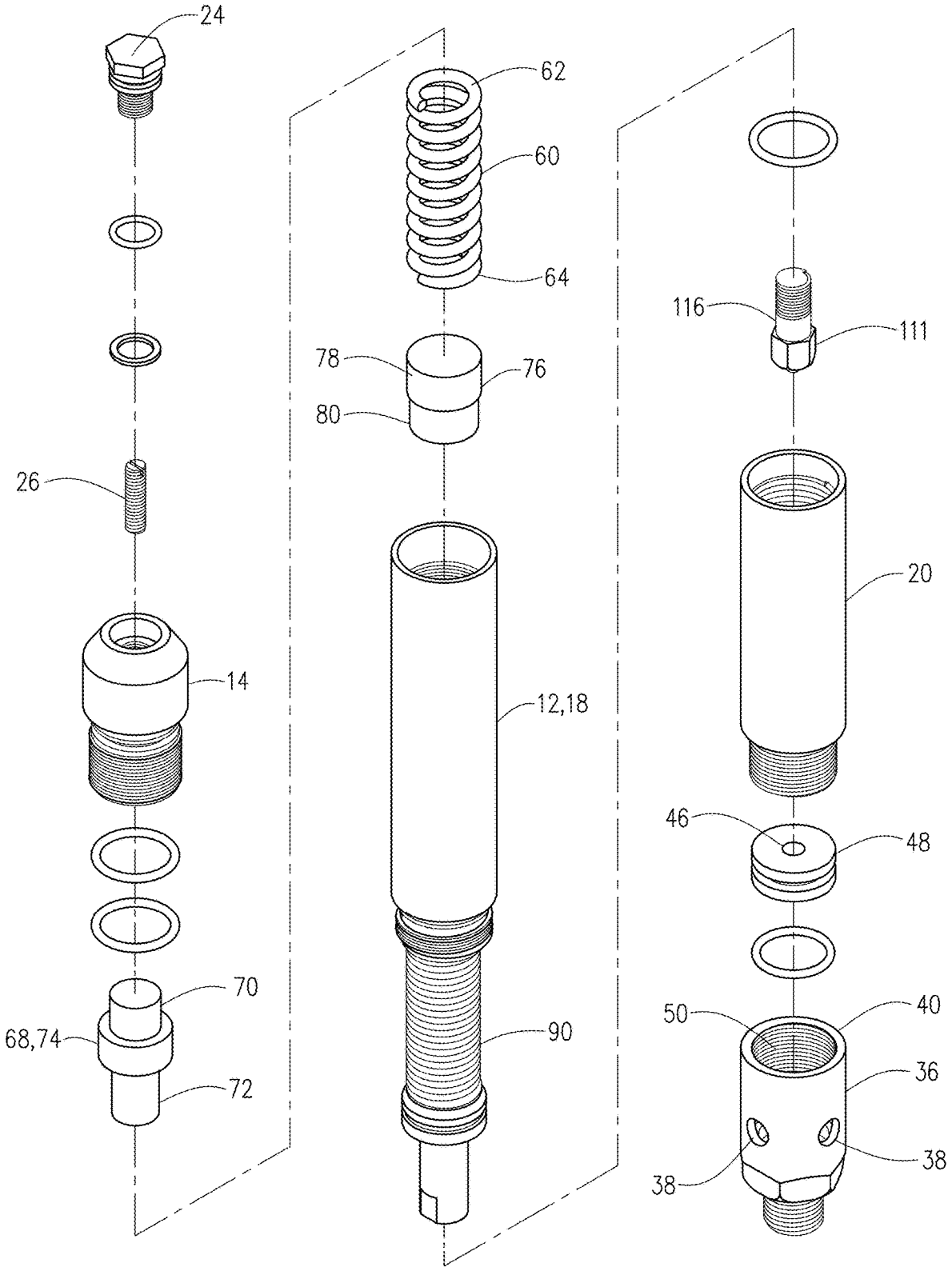
FIG. 5 is an exploded view of the gas lift valve.

FIG. 2 shows a gas lift valve 5 attached to a tubing joint 10 that is part of a production tubing 11 lowered into a wellbore 122 with casing 124 installed therein. Although shown as lowered into a cased wellbore, it is understood that the gas lift valve 5 disclosed herein can be used in open hole non-cased wellbores. Only one gas lift valve 5 is shown and described in FIG. 2, but it is understood that a production tubing 11 may have a plurality of gas lift valves 5 attached along its length as depicted in FIG. 1. Production tubing 11 has central flow passage 13 through which production fluid flows. Gas lift valve 5 comprises a housing 12 with upper and lower end 14 and 16, respectively. Housing 12 comprises a spring housing 18 connected to a bellows housing 20. A head portion 22 is connected to spring housing 18, and a cap 24 is threaded into head portion 22. A set screw 26 is threaded through a threaded port 28 in head portion 22 and extends therethrough. A cavity 30 is defined in a lower portion of head 22. Cavity 30 is larger than threaded port 28 and set screw 26 is configured so that a lower end 32 thereof will extend into cavity 30. O-ring seals 34 may be used to ensure sealing engagement between spring housing 18 and head portion 22.

A toe section 36 is connected to bellows housing 20. Toe section 36 has a plurality of inlet ports 38 defined in a wall 40 thereof and has an outlet 42 at a lower end 44 thereof. Inlet ports 38 may be referred to as injection fluid inlets 38, and outlet 42 may be referred to as injection fluid outlet 42. A ball seat 46 is defined in toe section 36 between the injection fluid inlets 38 and injection fluid outlet 42. In the described embodiment, ball seat 46 is defined on an insert 48 that is placed in an interior 50 of toe section 36. Insert 48 may be comprised of a hardened metal, such as for example tungsten carbide.

A biasing element, which may be a spring 60 with upper end 62 and lower end 64 is disposed in an interior 66 of housing 12 and will apply a downward force to a valve element to urge the valve element into the ball seat 46, which is a closed position of the gas lift valve in which no injection fluid is flowing therethrough. Spring 60 may be a compression spring, such as a wave spring or other spring capable of applying a downward force as described herein. A spring guide 68 with upper stem 70, lower stem 72 and guide ring 74 between the upper and lower stems is likewise positioned in housing 12. Lower stem 72 is inserted into the opening at the upper end 62 of spring 60. Upper stem 70 of spring guide 68 is received in cavity 30 of head portion 22. Top surface 71 of upper stem 70 may be engaged by set screw 26 so that set screw 26 may be used to adjust the compression of spring 60. Set screw 26 may be rotated in housing 12 which will adjust the amount of force applied by the biasing element 60, which adjusts the amount of injection fluid pressure needed to disengage the valve element from the ball seat 46, which is the open position of the gas lift valve that allows injection fluid to flow from the injection fluid inlet 38 through the injection fluid outlet 42.

A stop ring 76 is disposed in spring housing 18 at a lower end thereof and is slidable relative thereto. Stop ring 76 in one embodiment has first and second portions 78 and 80, where the second portion 80 has a slightly smaller diameter than the first portion 78. An upward facing shoulder 82 is defined in housing 12, and more specifically in spring housing 18.

A bellows assembly 90 is disposed in bellows housing 20. Bellows assembly 90 has upper end 92 and lower end 94. A bellows 96 is connected to and positioned between upper and lower stops 98 and 100. Upper stop 98 is defined on a lower end of a threaded extension 102 that extends upward into spring housing 18. Threaded extension 102 is pressed into, or otherwise attached to spring housing 18. Upward facing shoulder 82 is defined on extension 102. Extension 102 has threads thereon below a lower end of spring housing 18. Lower stop 100 is defined on a shoe 104. Bellows 96 are disposed about a bellows mandrel 106 that is connected to shoe 104. Bellows mandrel 106 extends upwardly from shoe 104 and has an upwardly extending bellows stem 108 with upper end 110 extending upwardly therefrom. Bellows stem 108 extends through an opening in extension 102, and is movable axially relative thereto. Stop ring 76 engages bellows stem 108 and the lower end 64 of spring 60 engages stop ring 76.

A valve element 111 comprises a valve stem 112 and a sealing ball 114. Valve stem 112 extends downwardly from bellows assembly 90 and specifically from shoe 104. Sealing ball 114 may be defined on a hex connector 116 on valve stem 112. In the closed position shown in the figures, sealing ball 114 will be engaged with ball seat 46 and will be urged downwardly into ball seat 46 by the spring force exerted from spring 60 through stop ring 76, bellows stem 108 and valve stem 112.

As schematically shown in FIG. 2, a check valve 120 of a type known in the art will be connected to toe section 36, and the gas lift valve 5 will be attached to tubing joint 10 in a manner known in the art. In operation, production tubing 11 with gas lift valve 5 will be lowered into a wellbore 122 which may have a casing 124 therein. Although depicted as a cased wellbore, it is understood that wellbore 122 may also be an open hole wellbore. An annulus 126 is defined between tubing joint 10 and casing 124. If it is determined that there is insufficient pressure to lift the production fluid in production tubing 11, gas is injected into annulus 126. The injected gas will enter gas lift valve 5 through inlet ports 38. The injected gas will urge the valve stem 112 and the attached sealing ball 114 upwardly off ball seat 46. The pressure applied by the injected gas will overcome the downward forces applied by the spring 60. Bellows stem 108 will push stop ring 76 upwardly to compress spring 60. The compression of spring 60 is adjustable by set screw 26. Set screw 26 may be threaded into cavity 30 a desired distance to engage spring guide 68 and apply a desired amount of force thereto to adjust the compression of spring 60. In doing so, the gas lift valve 5 is an adjustable valve, in that by adjusting the compression of spring 60, the amount of pressure applied by the injection gas needed to open the gas lift valve 5 can be adjusted.

Once sealing ball 114 is unseated, gas will flow through the check valve 120 and into tubing portion 10 to urge production fluid upwardly therein. No communication between flow passage 13 and injection fluid outlet 42 through check valve 120 is permitted until sealing ball 114 is disengaged from ball seat 46 by injection pressure in the annulus 126. The check valve 120 allows flow into flow passage 13 but prevents flow in the opposite direction. The valve element is isolated from flow passage 13, and from any pressure therein, until sealing ball 114 is disengaged from ball seat 46. Sealing ball 114 is thus disengaged from ball seat 46, and the valve element 111 moved from the closed to the open position, solely by injection fluid pressure in annulus 126. A plurality of gas lift valves 5 can be placed at desired intervals along a production tubing 11, and the amount of injection pressure needed to open the gas lift valves 5 slightly decreases as one moves downwardly along the production tubing 11. The following embodiments are disclosed:

Embodiment 1. A gas lift valve for use in a wellbore comprising a housing connected to a production tubing, the housing having an injection fluid inlet port and an injection fluid outlet; a valve seat positioned in the housing between the injection fluid inlet and the injection fluid outlet; a sealing ball; a biasing element positioned in the housing to urge the sealing ball into the valve seat; wherein the sealing ball is disengaged from the valve seat to open a pathway from the injection fluid inlet through the injection fluid outlet into the production tubing solely as a result of injection fluid pressure in an annulus between the housing and the wellbore.

Embodiment 2. The gas lift valve of embodiment 1, the biasing element comprising a compression spring disposed in the housing, the compression spring applying a downward force to the sealing ball.

Embodiment 3. The gas lift valve of embodiment 2, further comprising a set screw threadedly connected in the housing and operable to adjust a magnitude of the downward force applied by the compression spring.

Embodiment 4. The gas lift valve of embodiment 3, wherein a central flow passage of the production tubing is isolated from the injection fluid outlet until the injection pressure in the annulus disengages the sealing ball.

Embodiment 5. The gas lift valve of any of embodiments 1-4, wherein a downward force applied to the sealing ball by the biasing element is adjustable.

Embodiment 6. The gas lift valve of embodiment 5, further comprising a mandrel disposed in the housing; a stop ring engaged within the mandrel; a valve stem connected to the sealing ball and the mandrel, wherein the downward force applied to the sealing ball is applied through the mandrel.

Embodiment 7. The gas lift valve of embodiment 6, further comprising a check valve connected to the gas lift valve, wherein the check valve prevents communication between the injection fluid outlet to the production tubing prior to the time the sealing ball is disengaged from the valve seat.

Embodiment 8. A gas lift valve for use in a wellbore comprising a housing connected to a production tubing, the housing having at least one injection fluid inlet, and having an injection fluid outlet communicated with a flow passage of the production tubing; a valve element movable in the housing to move the gas lift valve between open and closed positions, wherein in the closed position flow from the injection fluid inlet to the injection fluid outlet is blocked and in the open position flow from the injection fluid inlet to the injection fluid outlet is permitted; and a biasing element disposed in the housing, wherein the biasing element applies a force to hold the valve element in the closed position, and wherein a flow passage of the production tubing is isolated from the valve element when the valve element is in the closed position.

Embodiment 9. The gas lift valve of embodiment 8, wherein the valve element is moved from the closed to the open position solely by injection fluid injected from the annulus into the at least one injection fluid inlet.

Embodiment 10. The gas lift valve of any of embodiments 8 and 9, wherein the biasing element comprises a compression spring.

Embodiment 11. The gas lift valve of any of embodiments 8-10, wherein an annular pressure required to move the valve element from the closed to the open position is adjustable.

Embodiment 12. The gas lift valve of any of embodiments 8-11, the annular pressure resulting from injection fluid injected into an annulus between the housing and the wellbore.

Embodiment 13. The gas lift valve of any of embodiments 8-12, further comprising a valve seat disposed in the housing, wherein the valve element is engaged with the valve seat in the closed position of the gas lift valve.

Embodiment 14. The gas lift valve of embodiment 13, further comprising a gas lift mandrel disposed in the housing, the valve element connected to the gas lift mandrel.

Embodiment 15. The gas lift valve of any of embodiments 8-14, further comprising a set screw threaded to the housing, wherein the set screw is operable to vary the force applied to the valve element.

Embodiment 16. A gas lift valve comprising a housing connected to a production tubing, the housing having an injection fluid outlet communicated with a flow passage of the production tubing; a valve element engaged with a ball seat disposed in the housing to prevent flow of fluid from the annulus from flowing through the injection fluid outlet, wherein in a closed position of the gas lift valve the valve element is exposed to pressure in an annulus between the housing of the wellbore but is isolated from pressure in the production tubing; and a spring disposed in the housing, the spring biasing the valve element to the closed position, the valve element movable to an open position in which flow is allowed from the annulus through the injection fluid outlet of the gas lift valve into the housing solely as a result of the pressure in the annulus.

Embodiment 17. The gas lift valve of embodiment 16, wherein the pressure in the annulus required to move the gas lift valve to the open position is adjustable.

Embodiment 18. The gas lift valve of embodiment 17, the spring comprising a compression spring.

Embodiment 19. The gas lift valve of any of embodiments 16-18, further comprising a check valve positioned between the valve element and the production tubing flow passage.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A gas lift valve for use in a wellbore comprising:

a housing connected to a production tubing, the housing having an injection fluid inlet port and an injection fluid outlet;

a valve seat positioned in the housing between the injection fluid inlet and the injection fluid outlet;

a sealing ball;

a biasing element positioned in the housing and operable to apply a downward force to the sealing ball to urge the sealing ball into the valve seat;

wherein the sealing ball is disengaged from the valve seat to open a pathway from the injection fluid inlet through the injection fluid outlet into the production tubing solely as a result of injection fluid pressure in an annulus between the housing and the wellbore; and an adjustment member connected in the housing, the adjustment member being rotatable in the housing, wherein rotation of the adjustment member adjusts the downward force applied to the sealing ball.

2. The gas lift valve of claim 1, wherein the biasing element comprising a compression spring disposed in the housing.

3. The gas lift valve of claim 2, the adjustment member comprising a set screw threadedly connected in the housing and operable to adjust a magnitude of the downward force applied by the compression spring.

4. The gas lift valve of claim 1, wherein a central flow passage of the production tubing is isolated from the injection fluid outlet until the injection fluid pressure in the annulus disengages the sealing ball.

5. The gas lift valve of claim 1, further comprising:

a mandrel disposed in the housing;

a stop ring engaged within the mandrel; and a valve stem connected to the sealing ball and the mandrel, wherein the downward force applied to the sealing ball is applied through the mandrel.

6. The gas lift valve of claim 5, further comprising a check valve connected to the gas lift valve, wherein the check valve prevents communication between the injection fluid outlet and the production tubing prior to the time the sealing ball is disengaged from the valve seat.

7. A gas lift valve for use in a wellbore comprising:

a housing connected to a production tubing, the housing having at least one injection fluid inlet, and having an injection fluid outlet communicated with a flow passage of the production tubing;

a valve element movable in the housing to move the gas lift valve between open and closed positions, wherein in the closed position flow from the injection fluid inlet to the injection fluid outlet is blocked and in the open position flow from the injection fluid inlet to the injection fluid outlet is permitted;

a biasing element disposed in the housing, wherein the biasing element applies a force to hold the valve element in the closed position, and wherein a flow passage of the production tubing is isolated from the valve element when the valve element is in the closed position; and an adjustment member positioned in the housing and operable to adjust the force applied to the valve element, thereby adjusting an amount of annular pressure needed to move the valve element from the closed to the open position.

8. The gas lift valve of claim 7, wherein the valve element is moved from the closed to the open position solely by injection fluid injected from the annulus into the at least one injection fluid inlet.

9. The gas lift valve of claim 7, wherein the biasing element comprises a compression spring.

10. The gas lift valve of claim 7, wherein the annular pressure results from injection fluid injected into an annulus between the housing and the wellbore.

11. The gas lift valve of claim 7, further comprising a valve seat disposed in the housing, wherein the valve element is engaged with the valve seat in the closed position of the gas lift valve.

12. The gas lift valve of claim 11, further comprising a gas lift mandrel disposed in the housing, wherein the valve element is connected to the gas lift mandrel.

13. The gas lift valve of claim 7, further comprising a set screw threaded to the housing, wherein the set screw is operable to adjust the force applied to the valve element.

14. A gas lift valve comprising:

a housing connected to a production tubing, the housing having an injection fluid outlet communicated with a flow passage of the production tubing;

a valve element engaged with a ball seat disposed in the housing to prevent flow of fluid from the annulus from flowing through the injection fluid outlet, wherein in a closed position of the gas lift valve the valve element is exposed to pressure in an annulus between the housing of the wellbore but is isolated from pressure in the production tubing; and a spring disposed in the housing, wherein the spring biases the valve element to the closed position, the valve element movable to an open position in which flow is allowed from the annulus through the injection fluid outlet of the gas lift valve into the housing solely as a result of the pressure in the annulus and wherein the biasing force applied by the spring is adjustable, thereby adjusting the amount of pressure in the annulus to move the valve element to the open position.

15. The gas lift valve of claim 14, the spring comprising a compression spring.

16. The gas lift valve of claim 14, further comprising a check valve positioned between the valve element and the production tubing flow passage.

* * * * *